US006012584A

United States Patent [19]

Dawson

[11] Patent Number: 6,012,584

[45] Date of Patent: Jan. 11, 2000

[54] PORTABLE KNIFE CONTAINMENT BOX

[76] Inventor: Robert A. Dawson, 441 E. Arrowood Rd. #9-1, Charlotte, N.C. 28217

[21] Appl. No.: 09/146,563

[22] Filed: Sep. 3, 1998

[51] Int. Cl.[7] ..... B65D 85/00

[52] U.S. Cl. ..... 206/553; 206/372

[58] Field of Search ..... 206/541, 542, 206/549, 550, 553, 372, 373; 211/70.7; 312/902

[56] References Cited

U.S. PATENT DOCUMENTS

| | | | |
|---|---|---|---|
| 244,898 | 7/1881 | Hoskins | 206/541 |
| 1,142,932 | 6/1915 | Clark | 206/550 X |
| 1,403,883 | 1/1922 | Woods | 206/373 X |
| 1,631,780 | 6/1927 | Zeitung | 206/373 X |
| 1,916,984 | 7/1933 | Naken | 206/373 |
| 2,505,510 | 4/1950 | Vermillion | 206/553 X |
| 2,694,485 | 11/1954 | Naken | 206/553 X |
| 3,135,383 | 6/1964 | Bloch | 206/553 |
| 4,303,188 | 12/1981 | Calabrese | 206/372 X |
| 4,979,610 | 12/1990 | Thomas | 206/553 X |

FOREIGN PATENT DOCUMENTS

| | | | |
|---|---|---|---|
| 446531 | 5/1936 | United Kingdom | 206/553 |
| 954608 | 4/1964 | United Kingdom | 206/553 |

*Primary Examiner*—Bryon P. Gehman

[57] ABSTRACT

A portable knife containment box is provided including a housing and a lid hingably coupled to the housing with a handle mounted. A plurality of knife containers are situated within the box to releasably receive knives. A pastry bag support is collapsibly coupled to the lid of the box.

7 Claims, 3 Drawing Sheets

FIG 3
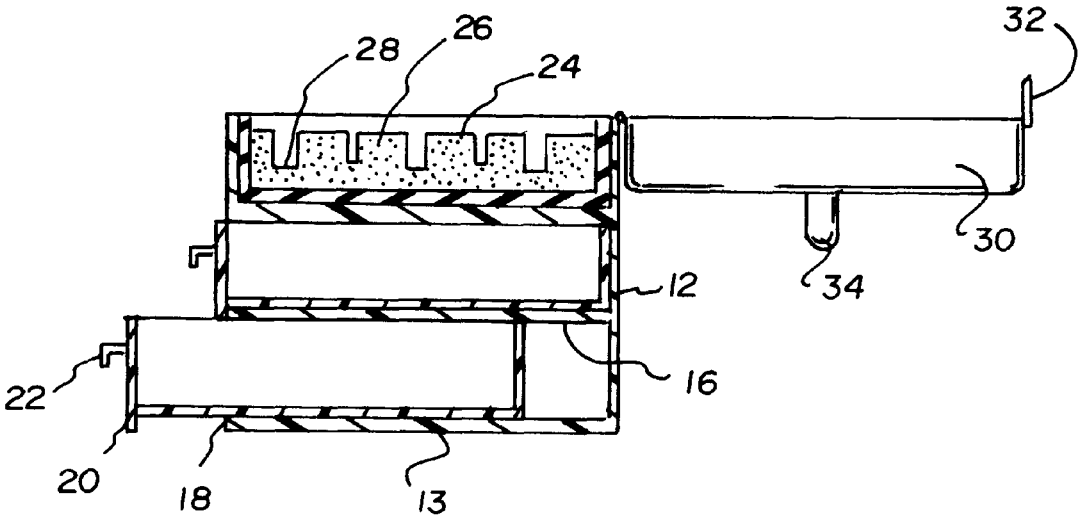
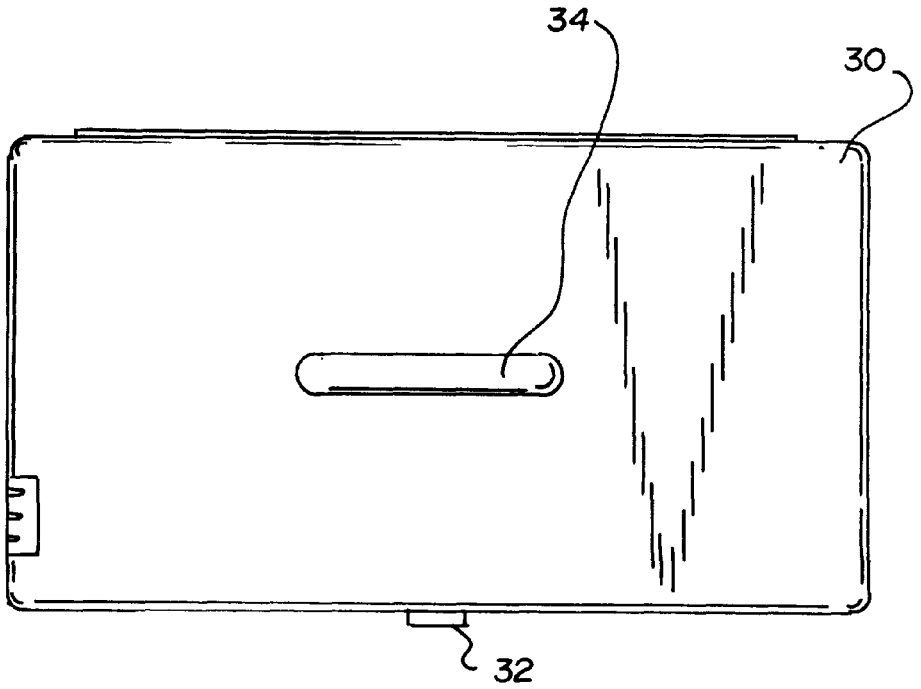
FIG 4

PORTABLE KNIFE CONTAINMENT BOX

BACKGROUND OF THE INVENTION

1. Field of the Invention

The present invention relates to knife containment units and more particularly pertains to a new portable knife box for storing and transporting knives and other utensils in a convenient manner.

2. Description of the Prior Art

The use of knife containment units is known in the prior art. More specifically, knife containment units heretofore devised and utilized are known to consist basically of familiar, expected and obvious structural configurations, notwithstanding the myriad of designs encompassed by the crowded prior art which have been developed for the fulfillment of countless objectives and requirements.

Known prior art knife containment units include U.S. Pat. No. 5,050,749; U.S. Pat. No. 2,089,537; U.S. Pat. No. Des. 333,238; U.S. Pat. No. 4,509,651; U.S. Pat. No. Des. 250, 440; and U.S. Pat. No. 1,939,497.

In these respects, the portable knife box according to the present invention substantially departs from the conventional concepts and designs of the prior art, and in so doing provides an apparatus primarily developed for the purpose of storing and transporting knives and other utensils in a convenient manner.

SUMMARY OF THE INVENTION

In view of the foregoing disadvantages inherent in the known types of knife containment units now present in the prior art, the present invention provides a new portable knife box construction wherein the same can be utilized for storing and transporting knives and other utensils in a convenient manner.

The general purpose of the present invention, which will be described subsequently in greater detail, is to provide a new portable knife box apparatus and method which has many of the advantages of the knife containment units mentioned heretofore and many novel features that result in a new portable knife box which is not anticipated, rendered obvious, suggested, or even implied by any of the prior art knife containment units, either alone or in any combination thereof.

To attain this, the present invention generally comprises a housing with a rectangular configuration and a first height. As shown in the various Figures, housing has a bottom face and a peripheral side wall integrally coupled to a periphery of the bottom face and extending upwardly therefrom. As such, an interior space and an open top with an upper peripheral edge are defined. The peripheral side wall includes a large front face, a large rear face and a pair of small side faces formed therebetween. As shown in FIG. 3, the housing further includes a pair of horizontal dividers mounted within the interior space between each of the facets of the peripheral side wall. The horizontal dividers include a lower divider mounted to the peripheral side wall a distance from the bottom face about ⅓ the first height. Associated therewith is an upper divider mounted to the peripheral side wall a distance from the bottom face about ⅔ the first height. The dividers thus form a pair of lower compartments and an upper compartment to which access is gained via the open top of the housing. For reasons that will soon become apparent, the front face of the housing has a pair of rectangular cut outs for affording access to the lower compartments. With reference still to FIG. 3, a pair of drawers are slidably situated within the lower compartments via the cut outs. Each drawer has a pair of laterally spaced, horizontally oriented handles for opening purposes. As shown in the Figures, each handle is equipped with an inverted L-shaped cross-section along a length thereof. FIG. 2 shows a pair of knife holders mounted in parallel relationship within the upper compartment between the front face and rear face of the peripheral side wall of the housing. The knife holders are preferably spaced a distance of ⅓ a width of the housing from the respective side face of the housing. Each knife holder includes a rectangular strip with a plurality of differently sized rectangular cut outs formed therein. By this structure, knives may be removably situated between cut outs of the knife holders. Next provided is a lid including a top face and a peripheral wall integrally coupled to a periphery of the top face and depending downwardly therefrom. The lid preferably has a second height which is about ⅓ the first height. The peripheral wall of the lid defines a lower peripheral edge which is hingably coupled to the upper peripheral edge of the housing. As shown in FIGS. 3 & 4, the lower peripheral edge of the lid further includes a latch situated opposite the hinged coupling. Such latch allows the selective securement of the lid in a closed orientation over the open top of the housing. Finally, the lid has an inverted U-shaped handle mounted on the top face thereof for carrying purposes. Situated on a periphery of the top face of the lid is a knife sharpener. The knife sharpener includes a rectangular metallic piece fixed within an recess formed in the top face of the lid. The metallic piece has a plurality of parallel grooves formed therein to slidably receive knives therein for sharpening purposes. A pair of pockets is mounted on an underside of the top face of the lid. Each pocket includes a rectangular flexible piece of material with a width about ⅓ that of the lid. As shown in FIG. 2, the pieces of material each have three edges coupled to one side of the lid such that the pieces of material define a pair of openings that face each other. Each piece of material is further secured to the underside of the top face of the lid along parallel lines for defining a plurality of sleeves. It should be noted that interior surfaces of the pieces of material and lid are lined with felt for affording protection to knives removably situated within the sleeves. For snappily engaging a cheese knife to the housing, a pair of laterally spaced C-shaped clips are mounted on the rear face of the peripheral side wall. As shown in FIG. 5, the clips are mounted adjacent to the upper peripheral edge of the housing. FIGS. 5 & 6 illustrate a pastry bag support including a first pair of legs each having a lower end pivotally coupled to the top face of the lid. Upper ends of the first pair of legs converge to a point at which an upper end of a third leg is pivotally mounted. A lower end of the third leg is removably mounted to the top face for defining a collapsible tripod for allowing a pastry bag to be supported thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable knife box apparatus and method which has many of the advantages of the knife containment units mentioned heretofore and many novel features that result in a new portable knife box which is not anticipated, rendered obvious, suggested, or even implied by any of the prior art knife containment units, either alone or in any combination thereof.

It is another object of the present invention to provide a new portable knife box which may be easily and efficiently manufactured and marketed.

It is a further object of the present invention to provide a new portable knife box which is of a durable and reliable construction.

An even further object of the present invention is to provide a new portable knife box which is susceptible of a low cost of manufacture with regard to both materials and labor, and which accordingly is then susceptible of low prices of sale to the consuming public, thereby making such portable knife box economically available to the buying public.

Still yet another object of the present invention is to provide a new portable knife box which provides in the apparatuses and methods of the prior art some of the advantages thereof, while simultaneously overcoming some of the disadvantages normally associated therewith.

Still another object of the present invention is to provide a new portable knife box for storing and transporting knives and other utensils in a convenient manner.

Even still another object of the present invention is to provide a new portable knife box that includes a housing and a lid hingably coupled to the housing with a handle mounted thereon for carrying purposes. Also included is a plurality of knife containers situated within the box to releasably receive knives for storage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side cross-sectional view of the present invention taken along line 3—3 shown in FIG. 2.

FIG. 4 is a top view of the present invention.

DESCRIPTION OF THE PREFERRED EMBODIMENT

Figure 1:
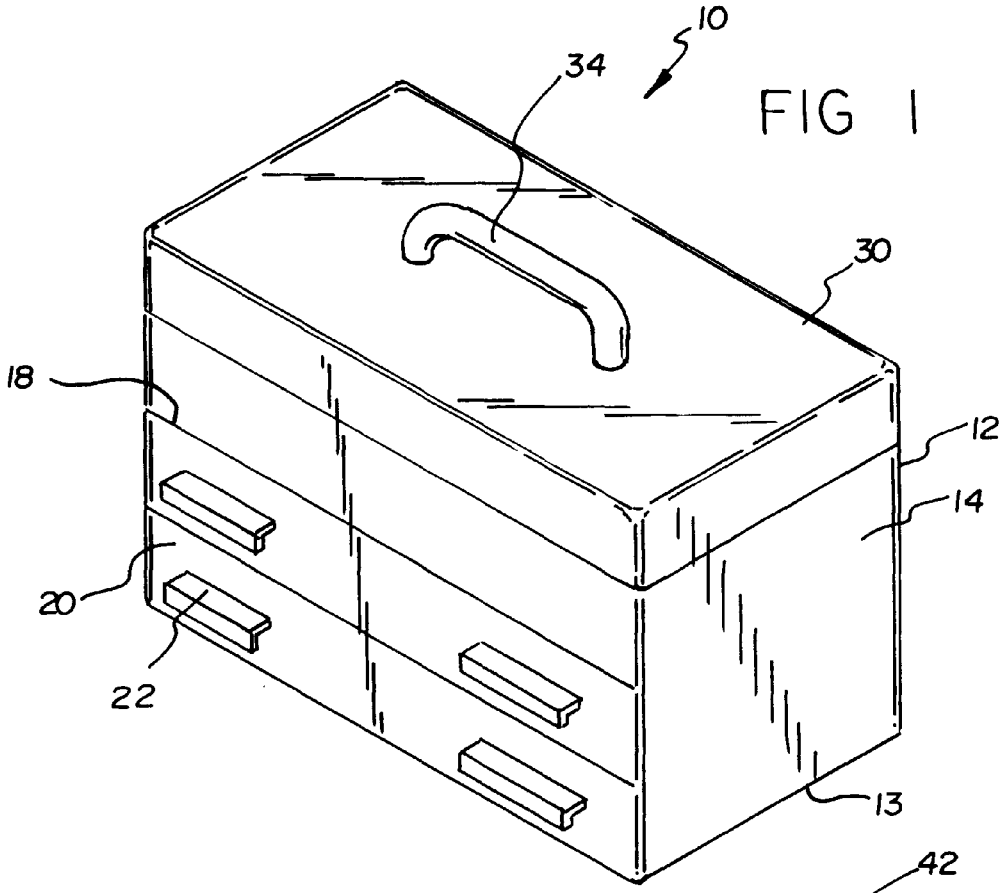
FIG. 1 is a perspective view of a new portable knife box according to the present invention.

With reference now to the drawings, and in particular to FIGS. 1 through 6 thereof, a new portable knife box embodying the principles and concepts of the present invention and generally designated by the reference numeral 10 will be described.

The present invention, designated as numeral 10, includes a housing 12 with a rectangular configuration and a first height. As shown in the various Figures, the housing has a bottom face 13 and a peripheral side wall 14 integrally coupled to a periphery of the bottom face and extending upwardly therefrom. As such, an interior space and an open top with an upper peripheral edge are defined. The peripheral side wall includes a large front face, a large rear face and a pair of small side faces formed therebetween.

As shown in FIG. 3, the housing further includes a pair of horizontal dividers 16 mounted within the interior space between each of the faces of the peripheral side wall. The horizontal dividers include a lower divider mounted to the peripheral side wall a distance from the bottom face about ⅓ the first height. Associated therewith is an upper divider mounted to the peripheral side wall a distance from the bottom face about ⅔ the first height. The dividers thus form a pair of lower compartments and an upper compartment to which access is gained via the open top of the housing. For reasons that will soon become apparent, the front face of the housing has a pair of rectangular cut outs 18 for affording access to the lower compartments.

With reference still to FIG. 3, a pair of drawers 20 are slidably situated within the lower compartments via the cut outs. Each drawer has a pair of laterally spaced, horizontally oriented handles 22 for opening purposes. As shown in the Figures, each handle is equipped with an inverted L-shaped cross-section along a length thereof. In use, the drawers may be employed to contain various gadgets and tools common around a kitchen.

Figure 2:
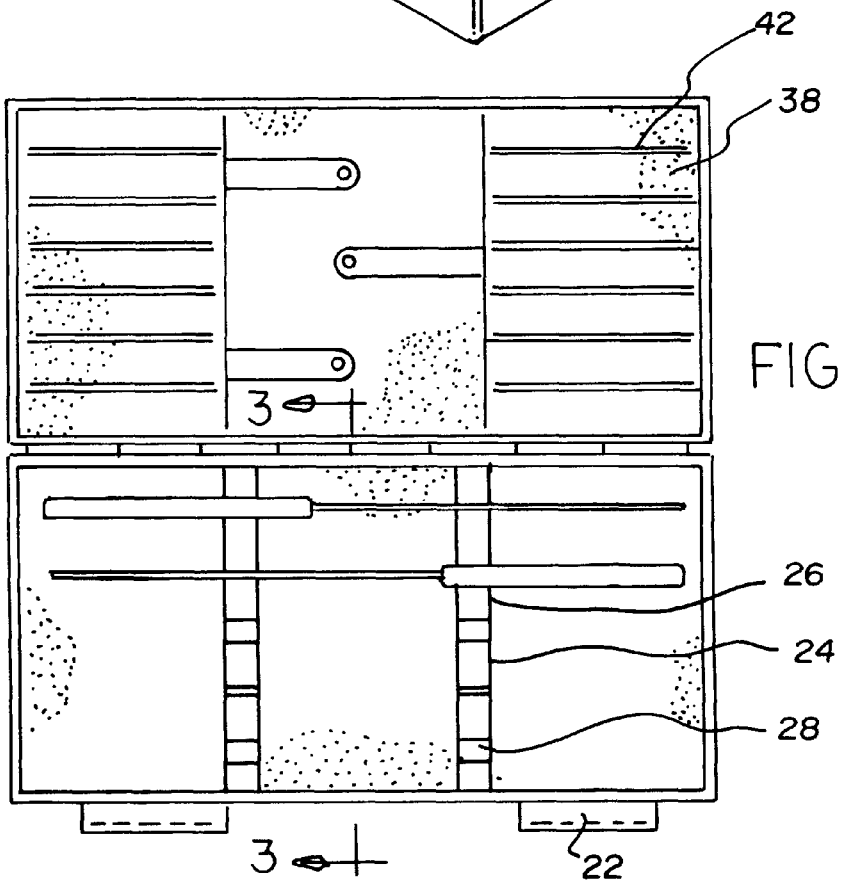
FIG. 2 is a top view of the present invention with the lid open.

FIG. 2 shows a pair of knife holders 24 mounted in parallel relationship within the upper compartment between the front face and rear face of the peripheral side wall of the housing. The knife holders are preferably spaced a distance of about ⅓ a width of the housing from the respective side face of the housing. Each knife holder includes a rectangular strip 26 with a plurality of differently sized rectangular cut outs 28 formed therein. By this structure, knives may be removably situated between corresponding cut outs of the knife holders. Each of the strips is preferably lined with felt or other type of protective material.

Next provided is a lid 30 including a top face and a peripheral wall integrally coupled to a periphery of the top face and depending downwardly therefrom. The lid preferably has a second height which is about ⅓ the first height. The peripheral wall of the lid defines a lower peripheral edge which is hingably coupled to the upper peripheral edge of the housing. As shown in FIGS. 3 & 4, the lower peripheral edge of the lid further includes a latch 32 situated opposite the hinged coupling. Such latch allows the selective securement of the lid in a closed orientation over the open top of the housing. Finally, the lid has an inverted U-shaped handle 34 mounted on the top face thereof for carrying purposes.

Situated on a periphery of the top face of the lid is a knife sharpener 36. The knife sharpener includes a rectangular metallic piece fixed within an recess formed in the top face of the lid. The metallic piece has a plurality of parallel grooves formed therein to slidably receive knives therein for sharpening purposes. So that the knives may be angled while sharpening, the grooves of the metallic piece preferably extend to the periphery of the top face and down a portion of the peripheral wall of the lid.

A pair of pockets 38 is mounted on an underside of the top face of the lid. Each pocket includes a rectangular flexible piece of material with a width about ⅓ that of the lid. As shown in FIG. 2, the pieces of material each have three edges coupled to one side of the lid such that the pieces of material define a pair of openings that face each other. Each piece of material is further secured to the underside of the top face of the lid along parallel lines 42 for defining a plurality of sleeves. It should be noted that interior surfaces of the pieces of material and lid are lined with felt for affording protection to knives removably situated within the sleeves.

Figure 5:
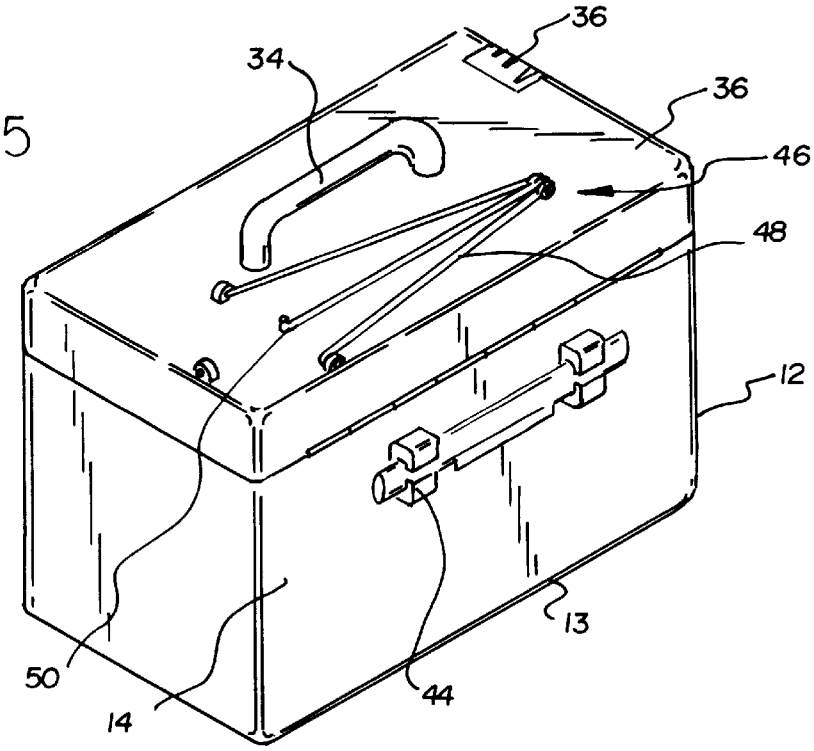
FIG. 5 is a perspective view of the present invention showing the pastry support in a collapsed orientation.

For snappily engaging a cheese knife to the housing, a pair of laterally spaced C-shaped clips 44 are mounted on the rear face of the peripheral side wall. As shown in FIG. 5, the clips are mounted adjacent to the upper peripheral edge of the housing.

Figure 6:
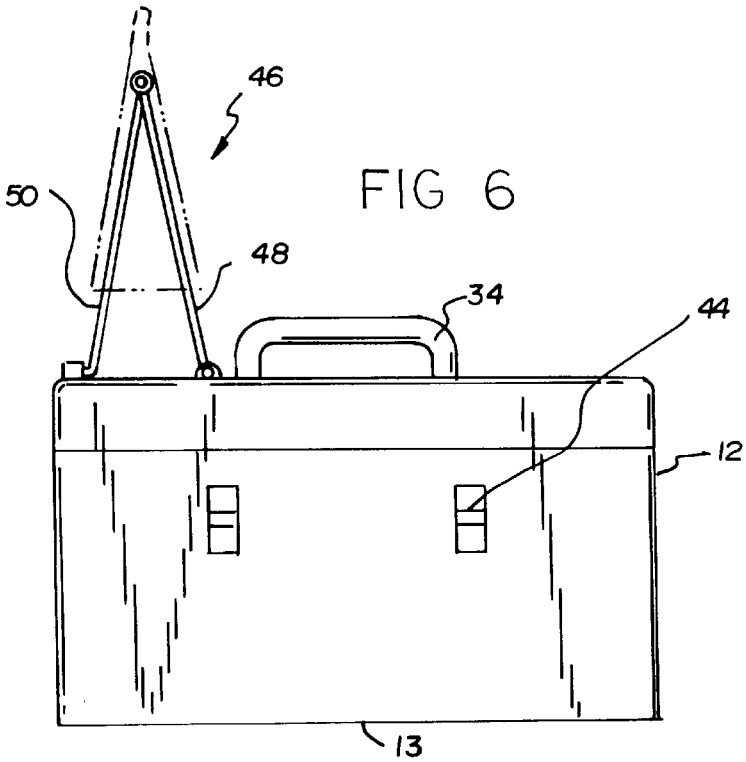
FIG. 6 is a rear view of the present invention showing the pastry support in an erected orientation.

FIGS. 5 & 6 illustrate a pastry bag support 46 including a first pair of legs 48 each having a lower end pivotally coupled to the top face of the lid. Such coupling is preferably effected between the handle of the lid and a rear edge thereof. Upper ends of the first pair of legs converge to a point at which an upper end of a third leg 50 is pivotally mounted. A lower end of the third leg is removably mounted to a side edge of the top face for defining a collapsible tripod for allowing a pastry bag to be supported thereon. Note FIG. 6.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A knife containment box comprising, in combination:

a housing with a rectangular configuration and a first height, the housing having a bottom face and a peripheral side wall integrally coupled to a periphery of the bottom face and extending upwardly therefrom to define an interior space and an open top with an upper peripheral edge, the peripheral side wall including a large front face, a large rear face and a pair of small side faces formed therebetween, the housing further including a pair of horizontal dividers mounted within the interior space between each of the faces of the peripheral side wall, the horizontal dividers including a lower divider mounted to the peripheral side wall a distance from the bottom face about ⅓ the first height and an upper divider recounted to the peripheral side wall a distance from the bottom face about ⅔ the first height for defining a pair of lower compartments and an upper compartment to which access is gained via the open top of the housing, the front face of the housing further including a pair of rectangular cut outs for affording access to the lower compartments;

a pair of drawers slidably situated within the lower compartments via the cut outs, each drawer having a pair of laterally spaced, horizontally oriented handles each with an inverted L-shaped cross-section along a length thereof;

a pair of knife holders mounted in parallel relationship within the upper compartment between the front face and rear face of the peripheral side wall of the housing, each knife holder including a rectangular strip with a plurality of differently sized rectangular cut outs formed therein, wherein knives may be removably situated between cut outs of the knife holders;

a lid including a top face and a peripheral wall integrally coupled to a periphery of the top face and depending downwardly therefrom a second height about ⅓ the first height, the peripheral wall adapted for defining a lower peripheral edge which is hingably coupled to the upper peripheral edge of the housing, the lower peripheral edge of the lid further including a latch situated opposite the hinged coupling for selectively securing the lid in a closed orientation over the open top of the housing, wherein the lid has an inverted U-shaped handle mounted on the top face thereof for carrying purposes;

a knife sharpener situated on a periphery of the top face of the lid, the knife sharpener including a rectangular metallic piece fixed within an recess formed in the top face of the lid, the metallic piece having a plurality of parallel grooves formed therein to slidably receive knives therein for sharpening purposes;

a pair of pockets mounted on an underside of the top face of the lid, each pocket including a rectangular flexible piece of material with a width about ⅓ that of the lid, the pieces of material each having three edges coupled to one side of the lid such that the pieces of material define a pair of openings that face each other, each piece of material further secured to the underside of the top face of the lid along parallel lines for defining a plurality of sleeves, wherein interior surfaces of the pieces of material and lid are lined with felt for affording protection to knives removably situated within the sleeves;

a pair of laterally spaced C-shaped clips mounted on the rear face of the peripheral side wall of the housing adjacent to the upper peripheral edge thereof, the clips being adapted for removably engaging a handle of a cheese knife; and a pastry bag support including a first pair of legs each having a lower end pivotally coupled to the top face of the lid, wherein upper ends of the first pair of legs converge to a point at which an upper end of a third leg is pivotally mounted, wherein a lower end of the third leg is removably mounted to the top face for defining a collapsible tripod for allowing a pastry bag to be supported thereon.

2. A portable knife containment box comprising:

a housing;

a lid hingably coupled to the housing;

a handle mounted on the box for carrying purposes;

a plurality of knife containers situated within the box for releasably receiving knives for storage purposes; and a pastry bag support including a first pair of legs each having a lower end pivotally coupled to the top face of the lid, wherein upper ends of the first pair of legs converge to a point at which an upper end of a third leg is pivotally mounted, wherein a lower end of the third leg is removably mounted to the lid for defining a collapsible tripod for allowing a pastry bag to be supported thereon.

3. The portable knife containment box as set forth in claim 2 wherein the knife containers include a plurality of sleeves mounted on an underside of the lid.

4. The portable knife containment box as set forth in claim 2 wherein the knife containers include a pair of parallel knife holders each including a strip mounted within the housing with a plurality of cut outs formed therein for releasably receiving knives.

5. The portable knife containment box as set forth in claim 2 wherein at least one drawer is slidably mounted on the housing.

6. The portable knife containment box as set forth in claim 2 wherein at least one clip is mounted on the box for releasably engaging a cheese knife.

7. The portable knife containment box as set forth in claim 2 wherein a knife sharpener is mounted on the lid of the box.

* * * * *